US008458988B2

(12) United States Patent
Kamenomostskiy

(10) Patent No.: US 8,458,988 B2
(45) Date of Patent: Jun. 11, 2013

(54) METHOD OF PRODUCING MINIMUM WEIGHT THIN WALL PROFILE MEMBERS

(76) Inventor: Aleksandr Kamenomostskiy, New York, NY (US)

( * ) Notice: Subject to any disclaimer, the term of this patent is extended or adjusted under 35 U.S.C. 154(b) by 0 days.

(21) Appl. No.: 13/317,871

(22) Filed: Oct. 31, 2011

(65) Prior Publication Data

US 2012/0210559 A1 Aug. 23, 2012

Related U.S. Application Data

(63) Continuation-in-part of application No. 12/462,521, filed on Aug. 5, 2009, now abandoned, which is a continuation of application No. 10/913,616, filed on Aug. 6, 2004, now abandoned, which is a continuation of application No. 10/149,049, filed on Jun. 4, 2002, now abandoned.

(30) Foreign Application Priority Data

Dec. 1, 2000 (RU) ..... RU00/00494

(51) Int. Cl.
*E04C 2/38* (2006.01)

(52) U.S. Cl.
USPC ..... 52/801.11; 52/837; 52/745.19

(58) Field of Classification Search
USPC ..... 52/801.11, 837, 839, 843, 745.19
See application file for complete search history.

(56) References Cited

U.S. PATENT DOCUMENTS

| | | | | |
|---|---|---|---|---|
| 2,246,578 | A * | 6/1941 | De Salardi | 428/593 |
| 3,442,542 | A * | 5/1969 | Watanabe | 403/300 |
| 3,995,081 | A * | 11/1976 | Fant et al. | 428/119 |
| 4,129,974 | A * | 12/1978 | Ojalvo | 52/837 |

OTHER PUBLICATIONS

Boeing Design Manual BDM-6080, Rev. A, May 1, 1992, pp. 1-44.
Kamenomostskiy, A.I.,"Structural Mechanics and Design of Buildings", Scientific-Technical Magazine, No. 5, 1990, Building Publishing House, Moscow, U.S.S.R. (English translation only).
Cohen, G.A., "Optimum Design of Truss-Core Sandwich Cylinders Under Axial Compression", Mar. 20, 1963, pp. 162-168, Aeronutronic Division, Ford Motor Company.

* cited by examiner

*Primary Examiner* — Basil Katcheves
(74) *Attorney, Agent, or Firm* — Adams & Wilks

(57) ABSTRACT

A minimum weight thin wall profile member is produced by selecting range values of cross section dimensions ratios for the thin wall profile member and various ratio values within the range values, and determining shape efficiency factor values $\Sigma_1, \Sigma_2 \ldots \Sigma_n$ based on the selected ratio values within the range values. Each shape efficiency factor value is determined using the expression $\Sigma=K_f \cdot K_m$, where $K_f=(i^2/F)^{2/5}$ is an overall stability factor, $K_m=K^{1/5}/(b/\delta_b)^{2/5}$ is a local stability factor, b, $\delta_b$ are the width and the thickness, respectively, of the main strip, i and F are the radius of gyration and the area of the cross-section, respectively, and K is the local stability stress coefficient. A maximum shape efficiency factor value $\Sigma_{max}$ is selected from the determined shape efficiency factor values, and the corresponding ratio values are used to produce the minimum weight thin wall profile member.

9 Claims, 3 Drawing Sheets

METHOD OF PRODUCING MINIMUM WEIGHT THIN WALL PROFILE MEMBERS

CROSS-REFERENCE TO RELATED APPLICATIONS

This application is a continuation-in-part of patent application Ser. No. 12/462,521, filed 5 Aug. 2009, now abandoned which is continuation of patent application Ser. No. 10/913,616, filed 6 Aug. 2004, now abandoned which is a continuation of patent application Ser. No. 10/149,049, filed 4 Jun. 2002, now abandoned which is the National Stage of International Application No. PCT/RU 00/00494, filed 1 Dec. 2000.

BACKGROUND OF THE INVENTION

1. Field of the Invention

The present invention pertains to a method of producing minimum weight thin wall profile members for building structures with strict qualifying requirements to reliable operation and minimum weight of the structure.

2. Background Information

Widespread types of structural units applied in building and in mechanical engineering are compressed thin wall structure members constituting thin wall profile members. They enable to meet strict operational requirements with respect to articles providing resolution of the "weight-strength" compromise, viz., stability and stiffness under compressive force providing minimization of weight. Minimization of the weight of thin wall structures encounters the issue of lack of a single dependence interconnecting multitude of parameters, in particular, critical stress, external load, material, dimensions and shape of cross-section of a thin wall profile member.

Known thin wall profile members (hereinafter, TPMs) are made with a shape and cross section dimensions constant along their length, for example, a TPM of a closed triangular or rectangular shape comprising main strip(s) and additional strip(s) with common reinforcing ribs [Reference 1]; [Reference 2, p. 33, FIG. 20]. The drawback of this known TPM is the narrow range of its applicability related to the restrictions brought about by its specific shape. Besides, the relations of dimensions of the cross section of this TPM are not optimal from the viewpoint of its weight minimization.

Other TPMs are made with a shape and cross-section dimensions constant along their length and comprise main strip(s) and additional strip(s) with common reinforcing rib(s) and free reinforcing ribs. As TPMs of such kind, the most common types of TPMs can be considered, for example, I-shaped, Z-shaped, C-shaped, T-shaped, L-shaped, etc, [Reference 3]; [Reference 4]; [Reference 2, p. 32, FIG. 18; p. 122, FIG. 111; p. 153, FIG. 142]. Embodiments of TPMs having these shapes and with known ratios of cross-section dimensions are not optimal either in terms of weight minimization.

Also TPMs are made with shapes and cross-section dimensions constant along their length and comprise main strip(s) and additional strip(s) with common reinforcing ribs and free reinforcing rib(s) such as, for example, a U-shaped TPM, [Reference 5]; [Reference 6]; [Reference 7]; [Reference 8]; [Reference 2, p. 110FIG. 101:, p. 111, FIG. 102].

During the production of these TPMs with the thus selected cross-section dimensions [References 1-8], the effect of "spacing" of cross section material was not accounted for accurately enough. As a result, at a higher moment of inertia, the respectively higher overall stability is achieved, while the local stability is thereby reduced. Due to this, it proves impossible to establish how close is the selected version of cross-section dimensions to the one with the minimum area, hence with the minimum TPM weight.

SUMMARY OF THE INVENTION

Accordingly, it is an object of the present invention to provide a method of producing minimum weight thin wall profile members which is a further improvement of known methods. The proposed method pertains, in respect of the problem formulation, to the class of primal analytic problems: given load, material, pattern of axes and overall dimensions of the structure, dimensions of cross-section shape (hereinafter, the shape dimensions) of thin profile members are found corresponding to the minimum weight of structures. The present method relating to the weight minimization problem is aimed at reduction of this number of parameters varied simultaneously, which cuts down the amount of calculations and, eventually, reduces time and cost of design and development work.

In keeping with these objects and with others which will become apparent hereinafter, one feature of the present invention resides in a method of producing a minimum weight thin wall profile member comprising the steps of: providing a thin wall profile member having a cross section that includes at least one of (1) at least two main strips and at least one additional strip having ends connecting with respective ends of two of the at least two main strips and selecting cross section dimensions such that each main strip has a thickness $\delta_b$ and a width b, and the additional strip has a thickness $\delta_a$, and a width a, and $\delta_b/b$ is no larger than $\delta_a/a$, and (2) at least one main strip and at least one additional strip having one end connecting with an end of the main strip and selecting dimensions such that the main strip has a thickness $\delta_b$ and a width b, the additional strip has a thickness $\delta_c$, and a width c, and $\delta_b/b$ is not larger than $\delta_c/c$; selecting range values of cross section dimensions for the thin wall profile member and several ratio values within the range values; determining, based on the several ratio values a plurality of shape efficiency factor values $\Sigma_1, \Sigma_2 \ldots \Sigma_n$, wherein each of the shape efficiency factor values is determined as:

$$\Sigma = K_f \cdot K_m,$$

where:

$K_f = (i^2/F)^{2/5}$ is an overall stability factor, $K_m = K^{1/5}/(b/\delta_b)^{2/5}$, is a local stability factor, b, $\delta_b$, are the width and the thickness of the main strip, respectively, i, F are the radius of gyration and the area of the cross section of the TPM, respectively, and K is the coefficient in the known formula for local stability critical stress, depending on the ratios of the TPM shape dimensions [Reference 2];

finding within the plurality of the determined shape efficiency factor values $\Sigma_1, \Sigma_2 \ldots \Sigma_n$ a maximum shape efficiency factor value $\Sigma_{max}$; ascertaining values of the ratios for the thin wall profile member which resulted in determination of the maximum shape efficiency factor value $\Sigma_{max}$; and producing the thin wall profile member with the values of the ratios which resulted in the maximum shape efficiency factor value $\Sigma_{max}$, so as to ensure a reliable operation of the thin wall profile member with a minimal weight.

In accordance with another feature of the present invention, the inventive method also includes finding maximum shape efficiency factor values for several thin wall profile members having different shapes, determining an overall maximum shape efficiency factor value $\Sigma_{0max}$ from the maximum shape efficiency factor values of all thin wall profile members, and producing the thin wall profile member with the shape which has the overall maximum shape efficiency factor value $\Sigma_{0max}$.

In the present invention, for the first time in order to produce thin wall profile members, the local stability and the overall stability of the thin wall profile members are determined, and for the first time an equality of the local stability and the overall stability is utilized to determine a maximum shape efficiency factor value for each shape of the thin wall profile members. The thin wall profile member which has a maximum shape efficiency factor value will have the local stability and overall stability which are equal to each other, and will have a minimal weight, and it is selected and produced by known methods.

The novel features which are considered as characteristics for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The method of producing minimum weight thin wall profile members in accordance with the present invention is explained in connection with the figures, wherein for better understanding main strips and additional strips will be illustrated as main and additional webs and flanges. With this, a web strip possesses two common longitudinal reinforcing ribs, while the flange strip possesses one common longitudinal reinforcing rib and one free longitudinal reinforcing rib.

DETAILED DESCRIPTION OF THE INVENTION

Figure 1:
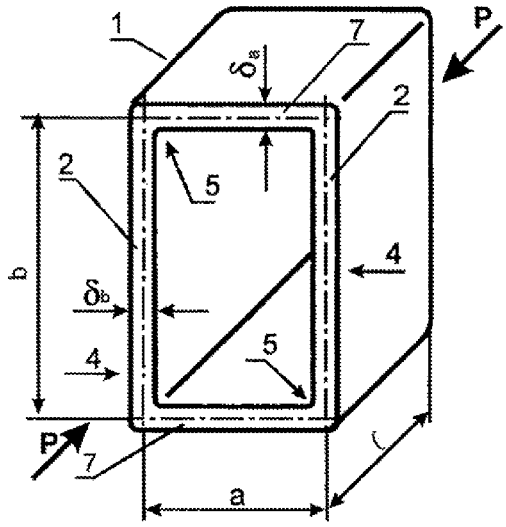
FIG. 1 shows a TPM of a rectangular shape with two main webs and two additional webs.

The subject matter of the present inventions may best be understood by reference to the following descriptions taken in connection with the accompanying drawings. In FIGS. 1 to 8, various shapes of TPMs denoted by numeral 1 are shown, dimensions of which are selected in accordance with the recommended ratios stipulated in the present invention. In FIGS. 1-8, the reference numerals denote main webs 2, main flanges 3, reinforcing ribs 5, additional flanges 6, and additional webs 7.

The TPMs are intended for reacting a compressive load P and can be embodied, for example, as rectangular (FIG. 1), triangular (FIG. 2), I- (FIG. 3), Z- (FIG. 4), C- (FIG. 5), T-(FIG. 6), L- (FIG. 7), and U- (FIG. 8) cross-sectional shapes. In FIGS. 1-8, the various dimensions for each TPM cross-sectional shape are represented as follows: a is the width of additional web 7; b is the width of main web 2 or main flange 3; c is the width of additional flange 6; $\delta_a$ is the thickness of additional web 7; $\delta_b$ is the thickness of main web 2 or main flange 3; $\delta_c$ is the thickness of additional flange 6; and l is the length of the TPM.

The TPMs comprise the main web(s) 2 (FIGS. 1 to 5, 8) or main flange 3 (FIGS. 6, 7) embodied as main strip(s) 4, possessing two common longitudinal reinforcing ribs or one free longitudinal reinforcing rib and one common longitudinal reinforcing rib 5, respectively. Additional flange(s) 6 (FIGS. 3 to 8) and web 7 (FIGS. 1, 2, 8) are embodied with a width less than that of the main strip 4 and with a thickness not less than that of the main strip 4.

By this construction, the stiffness of the main strip 4 does not exceed that of the additional strip (flanges 6, webs 7), specifically, $\delta_b/b$ is not larger than $\delta_a/a$. The stiffness of the additional strip with two common longitudinal reinforcing ribs, web 7 (FIG. 8), does not exceed the stiffness of the additional strip with one free longitudinal reinforcing rib and one common longitudinal reinforcing rib, flange 6 (FIG. 8), specifically, $\delta_a/a$ is not larger than $\delta_c/c$.

Figure 2:
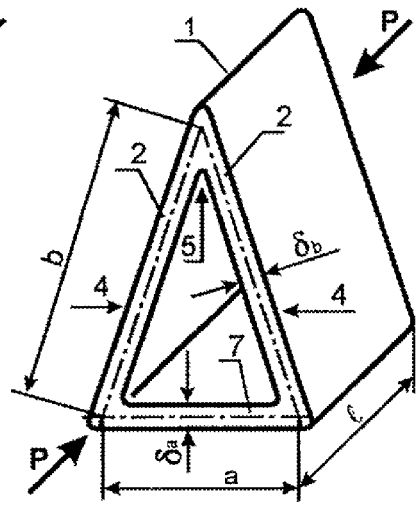
FIG. 2 shows a TPM of a triangular shape with two main webs and one additional web.
Figure 3:
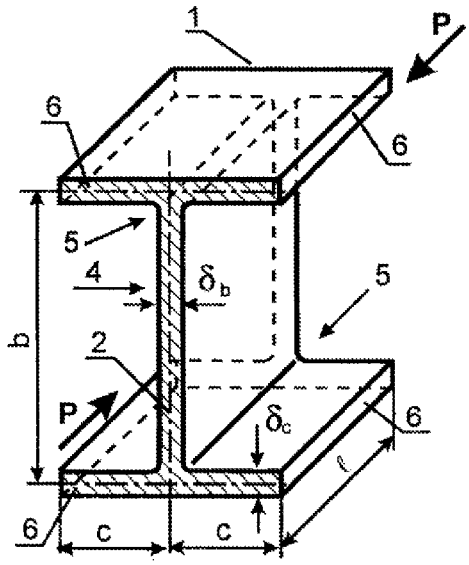
FIG. 3 shows an I-shaped TPM with one main web and four additional flanges.
Figure 4:
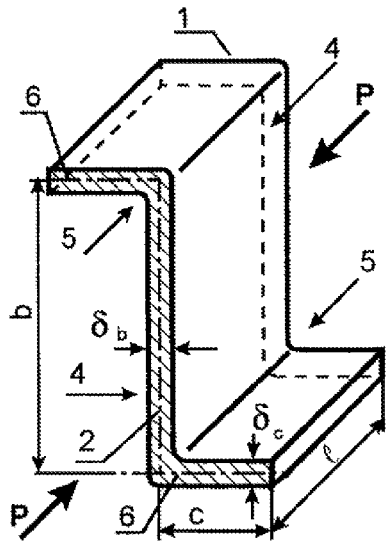
FIG. 4 shows a Z-shaped TPM with one main web and two additional flanges.
Figure 5:
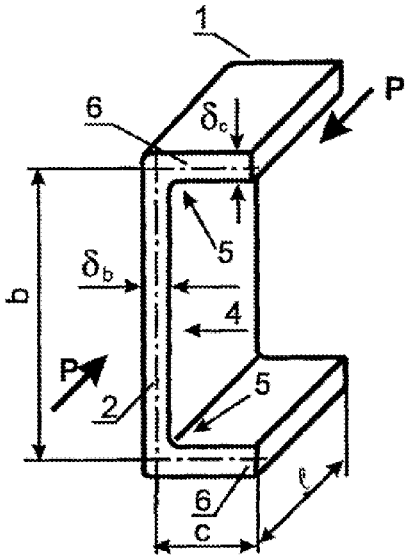
FIG. 5 shows a C-shaped TPM with one main web and two additional flanges.
Figure 6:
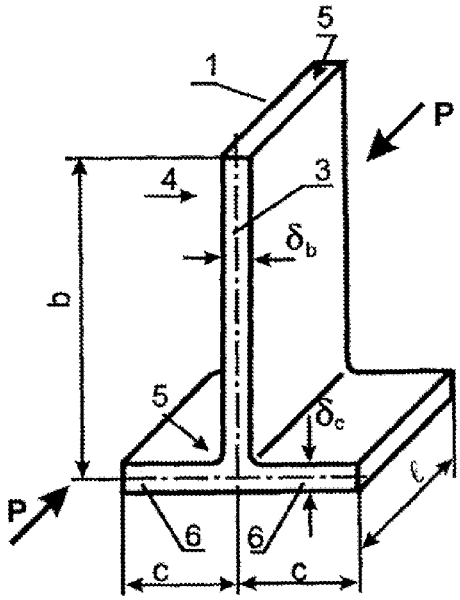
FIG. 6 shows a T-shaped TPM with one main flange and two additional flanges.
Figure 7:
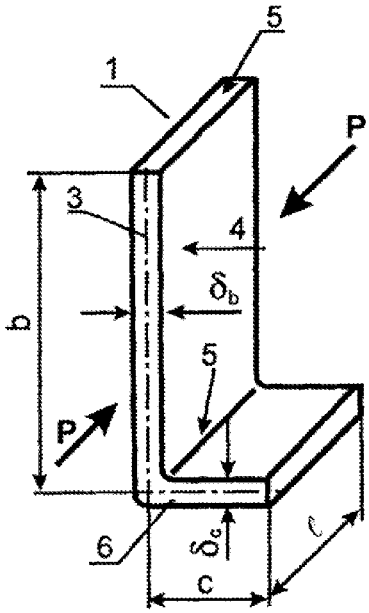
FIG. 7 shows an L-shaped TPM with one main flange and one additional flange.
Figure 8:
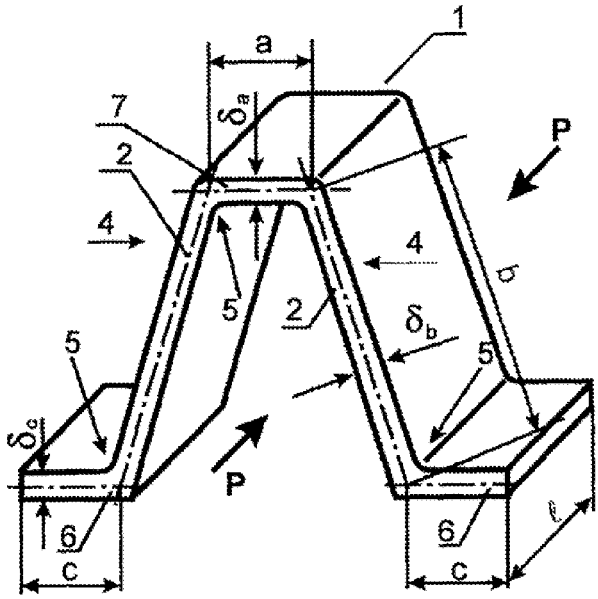
FIG. 8 shows a U-shaped TPM with two main inclined webs, one additional web and two additional flanges.

The additional flange 6 or the additional web 7 can be located with respect to main strip 4 at an angle of 90° (FIGS. 1, 3 to 7) or at a different angle (FIGS. 2, 8).

The width and thickness of the main webs 2, flanges 3 and additional webs 7, and flanges 6 in the TPM cross sections (FIGS. 1 to 8) satisfy the expressions:

$$a/b=0.3 \text{ to } 0.7;\ c/b=0.05 \text{ to } 0.3;\ \text{and } \delta_a/\delta_b=\delta_c/\delta_b=1.0 \text{ to } 3.0.$$

The range of values of ratios of widths and ratios of thicknesses of main webs 2 and main flanges 3, additional flanges 6 and additional webs 7 is obtained using the generalizing parameter with various TPM shapes, which the author introduced and called the shape efficiency factor Σ:

$$\Sigma=K_f K_m,$$

where:

$K_f=(i^2/F)^{2/5}$ is an overall stability factor, $K_m=K^{1/5}/(b/\delta_b)^{2/5}$, is a local stability factor, b, $\delta_b$ are the width and the thickness of the main web 2 or main flange 3, respectively, i, F are the radius of gyration and the area of the cross-section of the TPM in FIGS. 1 to 8, respectively, and K is the coefficient in the known formula for local stability critical stresses, depending on the ratios of the TPM shape dimensions [Reference 2].

Figure 9:
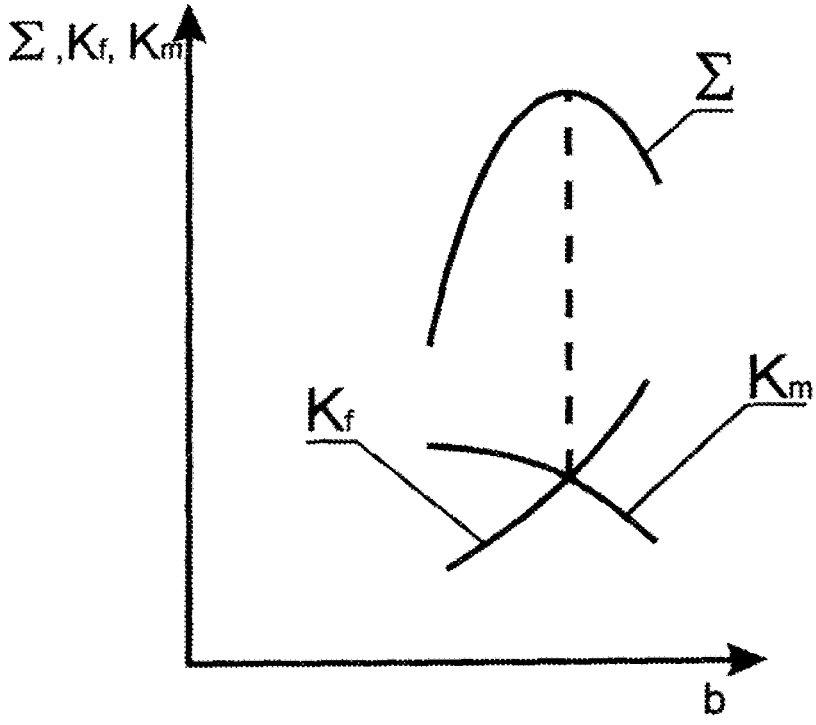
FIG. 9 is a plot diagram of the shape efficiency factor Σ versus the width b of the main strip of the TPM.

The graphic illustration of the shape efficiency factor Σ versus the width b of the main strip is shown in FIG. 9. As one can see from this plot, the factor Σ possesses, for each shape, a maximum value. For various TPM shapes, these maximum values correspond to the ranges of ratios of dimensions. Various shapes of TPMs can be compared in weight: the greater the maximum value of the factor Σ for a particular shape, the less is the TPM weight.

At the same time, within the specified ranges, maintaining the values of the above ratios, variation of shape absolute dimensions is possible which enables to provide for design/manufacturing restrictions not entailing a considerable increase of the weight of the TPM. Beyond these ranges, the weight of the TPM increases.

A method of producing minimum weight thin wall profile members in accordance with the present invention comprises: providing the thin wall profile members with a cross-section having at least one of (1) at least two main strips and at least one additional strip having ends connecting with respective ends of two of the main strips, and selecting dimensions such that the main strip has a thickness $\delta_b$ and a width b, the additional strip has a thickness $\delta_a$, and a width a, and $\delta_b/b$ is not larger than $\delta_a/a$, and (2) at least one main strip and at least one additional strip having one end connecting with an end of the main strip, the main strip has a thickness $\delta_b$ and a width b, the additional strip has a thickness $\delta_c$, and a width c, and $\delta_b/b$ is not larger than $\delta_c/c$; and choosing values of the ratios within a range for each of the thin wall profile members having a corresponding one of the cross sections.

In accordance with the present invention, range values of cross section dimensions ratios are selected for a thin wall profile member of each shape, and within the ranges of ratios for each thin wall profile member of each shape several values of ratios are selected.

Then for the thin wall profile member of the specific cross-sectional shape, a plurality of shape efficiency factor values $\Sigma_1, \Sigma_2 \ldots \Sigma_n$, are determined using the selected values of ratios within each range, wherein each shape efficiency factor value is determined as follows:

$$\Sigma = K_f K_m,$$

where:

$K_f = (i^2/F)^{2/5}$ is an overall stability factor, $K_m = K^{1/5}/(b/\delta_b)^{2/5}$, is a local stability factor, b, $\delta_b$, are the width and the thickness of the main strip, respectively, i, F are the radius of gyration and the area of the cross-section, respectively, and K is the coefficient in the known formula for local stability critical stresses, depending on the ratios of TPM shape dimensions [Reference 2].

From the plurality of the shape efficiency factor values $\Sigma_1, \Sigma_2 \ldots \Sigma_n$ determined this way, a maximum shape efficiency factor value $\Sigma_{max}$ is found. After this, values of the ratios in the thin wall profile member, which resulted in determination of the maximum shape efficiency factor value $\Sigma_{max}$ are ascertained.

Finally, the thin wall profile member with the values of the ratios which resulted in the maximum shape efficiency factor value is produced by known methods. This ensures a reliable operation of the produced thin wall profile member with a minimal weight.

For the thin wall profile member which has one of (1) a hollow, generally rectangular-shaped cross-section, with the longer sides of the rectangle comprising the main strips and each shorter side of the rectangle comprising the additional strip, and (2) a hollow, generally triangular-shaped cross-section, with two sides of the triangle comprising the main strips and a third side of the triangle comprising the additional strip, the ratio range values are:

$$a/b = 0.3 \text{ to } 0.7 \text{ and } \delta_a/\delta_b = 1.0 \text{ to } 3.0.$$

For the thin wall profile member which has a generally I-shaped cross-section, with the upright portion of the I shape comprising the main strip and each of four flanges forming the top and base of the I shape comprising the additional strip, the ratio range values are:

$$c/b = 0.05 \text{ to } 0.3 \text{ and } \delta_c/\delta_b = 1.0 \text{ to } 3.0.$$

For the thin wall profile member which has a generally Z-shaped cross-section, with the upright portion of the Z shape comprising the main strip, a flange at an angle to the main strip forming the top of the Z-shape comprising one of the additional strips, and a flange at an angle to the main strip forming the bottom of the Z shape comprising a second one of the additional strips, the ratio range values are:

$$c/b = 0.05 \text{ to } 0.3 \text{ and } \delta_c/\delta_b = 1.0 \text{ to } 3.0.$$

For the thin wall profile member which has generally C-shaped cross-section, with the upright portion of the C shape comprising the main strip, a flange forming the top of the C shape comprising one of the additional strips, and a flange forming the bottom of the C shape comprising a second one of the additional strips, the ratio range values are:

$$c/b = 0.05 \text{ to } 0.3 \text{ and } \delta_c/\delta_b = 1.0 \text{ to } 3.0.$$

For the thin wall profile member which has a generally T-shaped cross-section, with the upright portion of the T shape comprising the main strip and each of two flanges forming the top of the T shape comprising the additional strip, the ratio range values are:

$$c/b = 0.05 \text{ to } 0.3 \text{ and } \delta_c/\delta_b = 1.0 \text{ to } 3.0.$$

For the thin wall profile member which has member a generally L-shaped cross-section, with the upright portion of the L shape comprising the main strip and a flange forming the bottom of the L shape comprising the additional strip, the ratio range values are:

$$c/b = 0.05 \text{ to } 0.3 \text{ and } \delta_c/\delta_b = 1.0 \text{ to } 3.0.$$

For the thin wall profile member which has a generally U-shaped cross-section with the sides of the U shape comprising the main strip, the bottom of the U shape comprising the additional strip, and flanges extending from the ends of the legs of the U shape comprising two of the additional strips, the ratio range values are:

$$a/b = 0.3 \text{ to } 0.7 \text{ and } \delta_a/\delta_b = 1.0 \text{ to } 3.0; \text{ and}$$

$$c/b = 0.05 \text{ to } 0.3 \text{ and } \delta_c/\delta_b = 1.0 \text{ to } 3.0.$$

An example of designing and producing the thin wall profile member with a generally I-shaped cross section is presented herein below.

The ratio range values for the I-shaped thin wall profile member are c/b=0.05 to 0.3 and $\delta_c/\delta_b$=1.0 to 3.0. From these range values the following variants of values of the ratios are selected:

| Variant | 1 | 2 | 3 | 4 | 5 |
|---|---|---|---|---|---|
| c/b | 0.05 | 0.15 | 0.2 | 0.4 | 0.4 |
| $\delta_c/\delta_b$ | 2.5 | 2.0 | 1.0 | 0.5 | 3.3 |

For the I-shaped thin wall profile member and the selected variants values of ratios, the values of the shape efficiency factors are as follows:

$\Sigma_1$=0.556, $\Sigma_2$=0.538, $\Sigma_3$=0.513, $\Sigma_4$=0.415, $\Sigma_5$=0.379 respectively.

It can be seen that the values of $\Sigma_4$ and of $\Sigma_5$ based on ratio values outside the range are significantly less.

It can be further seen from the values of $\Sigma_1, \Sigma_2, \Sigma_3$, based on the ratio values within the range the shape efficiency factor $\Sigma_1$ has a maximum value.

The shape efficiency factor $\Sigma_1$ value was obtained from the ratio values c/b=0.05 and $\delta_c/\delta_b$=2.5.

Then the I-shaped thin wall profile member with the ratio values c/b=0.05 and $\delta_c/\delta_b$=2.5 is produced by known methods.

The ranges of ratios of dimensions for the thin wall profile members of each shape are selected so that all shape efficiency factor values based on ratios of dimensions of each range do not differ significantly from the maximum shape efficiency factor value for this shape within the range.

In accordance with a further embodiment of the invention for selecting the most efficient thin wall profile member with minimum weight from the thin wall profile members of different shapes, a plurality of maximum shape efficiency factor values $\Sigma_{max}1$, $\Sigma_{max}2$ . . . $\Sigma_{max}N$, are determined for all thin wall profile members of different shapes, an overall maximum shape efficiency factor value $\Sigma_{Omax}$ is determined from the maximum shape efficiency factor values of the thin wall profile members of different shapes, and the thin wall profile member of that shape is produced having the overall maximum shape efficiency factor value $\Sigma_{0max}$.

It will be understood that each of the elements described above, or two or more together, may also find a useful application in other types of methods differing from the type described above.

While the invention has been illustrated and described as embodied in a method of producing thin wall profile members, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

REFERENCES

1. U.S. Pat. No. 4,912,903, E04C 3/04, Apr. 3, 1990
2. Hertel, H, Thin wall structures.—Moscow, "Mashinostroyeniye", 1965 527 p. [in Russian; translation from: Hertel, H, Leichtbau: Bauelemente Bemessungen and Konstruktionen von Flugzeugen und anderen Leichtbauwerken. Springer-Verlag, Berlin]
3. WO 92/09767, EO4C 3/04, Jun. 11, 1992
4. U.S. Pat. No. 5,518,208, B64C1/06, May 21, 1996
5. WO 91/05925, E04C 2/08, May 2, 1991
6. U.S. Pat. No. 5,842,318, E04C 3/07, Dec. 1, 1998
7. WO 96/30606, E04C 3/07, 3/09, 3/292, Oct. 3, 1996
8. WO 00/17463, E04C 3/07, Mar. 30, 2000

The invention claimed is:

1. A method of producing a thin wall profile member, comprising the steps of:

providing a thin wall profile member having a cross section including at least one of (1) at least two main strips and at least one additional strip having ends connecting with respective ends of two of said main strips, and selecting cross section dimensions such that said main strip has a thickness $\delta_b$ and a width b, said additional strip has a thickness $\delta_a$ and a width a, and $\delta_b$/b is no larger than $\delta_a$/a, and (2) at least one main strip and at least one additional strip having one end connecting with an end of said main strip, said main strip having a thickness $\delta_b$ and a width b, said additional strip having a thickness $\delta_c$, and a width c, and $\delta_b$/b being no larger than $\delta_c$/c;

selecting range values of cross section dimensions ratios for the thin wall profile member and various ratio values within the range values;

determining for the thin wall profile member a plurality of shape efficiency factor values $\Sigma_1, \Sigma_2 \ldots \Sigma_n$ based on the selected ratio values within the range values, wherein each of the shape efficiency factor values is determined as $$\Sigma = K_f K_m,$$

where:

$K_f = (i^2/F)^{2/5}$, is an overall stability factor, $K_m = K^{1/5}/(b/\delta_b)^{2/5}$, is a local stability factor, b, $\delta_b$, are the width and the thickness of said main strip, respectively, i, F, are the radius of gyration and the area of said cross section, respectively, and K is the coefficient in the known formula for local stability critical stress;

finding within the plurality of the shape efficiency factor values $\Sigma_1, \Sigma_2 \ldots \Sigma_n$ for the thin wall profile member, a maximum shape efficiency factor value $\Sigma_{max}$;

ascertaining the ratio values for the thin wall profile member which resulted in the maximum shape efficiency factor value $\Sigma_{max}$; and producing the thin wall profile member with the ratio values which resulted in the maximum shape efficiency factor value $\Sigma_{max}$, so as to ensure a reliable operation of the thin wall profile member with a minimal weight.

2. The method of claim 1, wherein said selecting includes for said member which has one of (1) a hollow, generally rectangular-shaped cross section, with the longer sides of said rectangle comprising said main strips and each shorter side of said rectangle comprising a said additional strip, and (2) a hollow, generally triangular-shaped cross section, with two sides of said triangle comprising said main strips and a third side of said triangle comprising said additional strip, the ratio range values:

$$a/b = 0.3 \text{ to } 0.7 \text{ and } \delta_a/\delta_b = 1.0 \text{ to } 3.0.$$

3. The method of claim 1, wherein said selecting includes for said member which has a generally I-shaped cross section, with the upright portion of said I comprising said main strip and each of four flanges forming the top and base of said I comprising said additional strip, the ratio range values:

$$c/b = 0.05 \text{ to } 0.3 \text{ and } \delta_c/\delta_b = 1.0 \text{ to } 3.0.$$

4. The method of claim 1, wherein said selecting includes for said member which has a generally Z-shaped cross section, with the upright portion of said Z comprising said main strip, a flange at an angle to said main strip forming the top of said Z comprising one said additional strip, and a flange at an angle to said main strip forming the bottom of said Z comprising a second said additional strip, the ratio range values:

$$c/b = 0.05 \text{ to } 0.3 \text{ and } \delta_c/\delta_b = 1.0 \text{ to } 3.0.$$

5. The method of claim 1, wherein said selecting includes for said member which has a generally C-shaped cross section, with the upright portion of said C comprising said main strip, a flange forming the top of said C comprising one said additional strip, and a flange forming the bottom of said C comprising a second said additional strip, the ratio range values:

$$c/b = 0.05 \text{ to } 0.3 \text{ and } \delta_c/\delta_b = 1.0 \text{ to } 3.0.$$

6. The method of claim 1, wherein said selecting includes for said member which has a generally T-shaped cross section, with the upright portion of said T comprising said main strip and each of two flanges forming the top of said T comprising said additional strip, the ratio range values:

$$c/b = 0.05 \text{ to } 0.3 \text{ and } \delta_c/\delta_b = 1.0 \text{ to } 3.0.$$

7. The method as defined in claim 1, wherein said selecting includes for said member which has a generally L-shaped cross section, with the upright portion of said L comprising said main strip and a flange forming the bottom of said L comprising said additional strip; the ratio range values:

$c/b$=0.05 to 0.3 and $\delta_c/\delta_b$=1.0 to 3.0.

8. The method of claim 1, wherein said selecting includes for said member which has a generally U-shaped cross section with the sides of said U comprising said main strip, the bottom of said U comprising said additional strip, and flanges extending from the ends of the legs of said U comprising two said additional strips, the ratio range values:

$a/b$=0.3 to 0.7 and $\delta_a/\delta_b$=1.0 to 3.0; and $c/b$=0.05 to 0.3 and $\delta_c/\delta_b$=1.0 to 3.0.

9. The method of claim 1, further comprising: determining a plurality of maximum shape efficiency factor values $\delta_{max}\mathbf{1}$, $Z_{max}\mathbf{2} \ldots \Sigma_{max}N$ for respective ones of a plurality of thin wall profile members having different shapes; selecting from the determined plurality of maximum shape efficiency factor values $\Sigma_{max}\mathbf{1}$, $\Sigma_{max}\mathbf{2} \ldots \Sigma_{max}N$ an overall maximum shape efficiency factor value $\Sigma_{0max}$; and producing the thin wall profile member of that shape which has the overall maximum shape efficiency factor value $\Sigma_{0max}$.

* * * * *

UNITED STATES PATENT AND TRADEMARK OFFICE

CERTIFICATE OF CORRECTION

PATENT NO. : 8,458,988 B2
APPLICATION NO. : 13/317871
DATED : June 11, 2013
INVENTOR(S) : Aleksandr Kamenomostskiy It is certified that error appears in the above-identified patent and that said Letters Patent is hereby corrected as shown below:

ON THE TITLE PAGE

In the illustrative figure:

Change the reference character "a" located above the double-headed arrow denoting the width of additional strip 7 to -- *a* --.

Change the reference character "$\delta_a$" to -- $\delta_a$ --.

The unclear designation for the double-headed arrow located at the lower right side of the figure and oriented perpendicular to the double-headed arrow denoted by reference character "c" should be -- *l* --.

IN THE DRAWINGS

Figure 1:

Change the reference character "a" located above the double-headed arrow denoting the width of additional strip 7 to -- *a* --.

Change the reference character "$\delta_a$" to -- $\delta_a$ --.

The unclear designation for the double-headed arrow located at the lower right side of the figure and oriented perpendicular to the double-headed arrow denoted by reference character "a" should be -- *l* --.

Signed and Sealed this
Second Day of June, 2015

Michelle K. Lee

Michelle K. Lee
*Director of the United States Patent and Trademark Office*

IN THE DRAWINGS (cont.)

Figure 2:

Change the reference character "a" located above the double-headed arrow denoting the width of additional strip 7 to -- *a* --.

Change the reference character "$\delta_a$" to -- $\delta_a$ --.

The unclear designation for the double-headed arrow located at the lower right side of the figure and oriented perpendicular to the double-headed arrow denoted by reference character "a" should be -- *l* --.

Figure 3:

The unclear designation for the double-headed arrow located at the lower right side of the figure and oriented perpendicular to the double-headed arrow denoted by reference character "c" should be -- *l* --.

Figure 4:

The unclear designation for the double-headed arrow located at the lower right side of the figure and oriented perpendicular to the double-headed arrow denoted by reference character "c" should be -- *l* --.

Figure 5:

The unclear designation for the double-headed arrow located at the lower right side of the figure and oriented perpendicular to the double-headed arrow denoted by reference character "c" should be -- *l* --.

Figure 6:

The unclear designation for the double-headed arrow located at the lower right side of the figure and oriented perpendicular to the double-headed arrow denoted by reference character "c" should be -- *l* --.

Figure 7:

The unclear designation for the double-headed arrow located at the lower right side of the figure and oriented perpendicular to the double-headed arrow denoted by reference character "c" should be -- *l* --.

IN THE DRAWINGS (cont.)

Figure 8:

Change the reference character "a" located above the double-headed arrow denoting the width of additional strip 7 to -- *a* --.

Change the reference character "$\delta_a$" to -- $\delta_a$ --.

The unclear designation for the double-headed arrow located at the lower right side of the figure and oriented perpendicular to the double-headed arrow denoted by reference character "c" should be -- *l* --.

IN THE SPECIFICATION

Col. 2, ln. 31, change "width a" to -- width *a* -- and change "$\delta_a$/a" to -- $\delta_a/a$ --.

Col. 4, ln. 2, change "a is" to -- *a* is --.

Col. 4, ln. 7, change "and l" to -- and *l* --.

Col. 4, ln. 18, change "$\delta_a$/a" to -- $\delta_a/a$ --.

Col. 4, ln. 23, change "$\delta_a$/a" to -- $\delta_a/a$ --.

Col. 5, ln. 4, change "width a," to -- width *a*, --.

Col. 5, ln. 5, change "$\delta_a$/a" to -- $\delta_a/a$ --.

IN THE CLAIMS

Claim 1, col. 7, ln. 57, change "width a" to -- width *a* -- and change "$\delta_a$/a" to -- $\delta_a/a$ --.